US010912431B2

(12) United States Patent
Grin et al.

(10) Patent No.: US 10,912,431 B2
(45) Date of Patent: Feb. 9, 2021

(54) HINGE ASSEMBLY FOR TOILET

(71) Applicant: Kohler Co., Kohler, WI (US)

(72) Inventors: Lawrence A. Grin, Fond du Lac, WI (US); Carlos F. Uceda, Sheboygan, WI (US); Sierra Messenger, Port Washington, WI (US); Megan Farrish, Sheboygan, WI (US); Andra Wibisono, Cibubur (ID)

(73) Assignee: Kohler Co., Kohler, WI (US)

( * ) Notice: Subject to any disclaimer, the term of this patent is extended or adjusted under 35 U.S.C. 154(b) by 3 days.

(21) Appl. No.: 16/504,601

(22) Filed: Jul. 8, 2019

(65) Prior Publication Data

US 2020/0015641 A1 Jan. 16, 2020

Related U.S. Application Data

(60) Provisional application No. 62/696,008, filed on Jul. 10, 2018, provisional application No. 62/713,045, filed on Aug. 1, 2018.

(51) Int. Cl.
*A47K 13/12* (2006.01)
*E05D 3/14* (2006.01)

(52) U.S. Cl.
CPC ..... *A47K 13/12* (2013.01); *E05D 3/14* (2013.01); *E05Y 2900/614* (2013.01)

(58) Field of Classification Search
CPC ..... A47K 13/12; E05D 3/14; E05Y 2900/614
See application file for complete search history.

(56) References Cited

U.S. PATENT DOCUMENTS

| | | | |
|---|---|---|---|
| 1,804,114 | A | 5/1931 | Pudliner |
| 2,996,731 | A | 8/1961 | Leptrone |
| 4,315,338 | A | 2/1982 | Harrison |
| 4,491,989 | A | 1/1985 | McGrail |
| 4,581,778 | A | 4/1986 | Pontoppidan |
| 4,939,796 | A | 7/1990 | Pepper |
| 4,958,387 | A | 9/1990 | Fait |
| 5,012,551 | A | 5/1991 | Beneke et al. |
| 5,060,318 | A | 10/1991 | Jaskiewicz |
| 5,193,228 | A | 3/1993 | Murasawa et al. |
| 5,461,734 | A | 10/1995 | Faircloth |
| 5,570,478 | A | 11/1996 | Armstrong |

(Continued)

FOREIGN PATENT DOCUMENTS

| | | | |
|---|---|---|---|
| FR | 2888274 | A1 | 1/2007 |
| WO | WO-93/06765 | A1 | 4/1993 |

*Primary Examiner* — Jeremy Carroll
(74) *Attorney, Agent, or Firm* — Lempia Summerfield Katz LLC

(57) ABSTRACT

A toilet includes a body, a lid assembly, and a hinge assembly. The body includes a bowl and a body top surface. The body top surface is contiguous with the bowl. The lid assembly includes a lid. The lid is configured to cover the bowl. The hinge assembly is operable between a first position and a second position. The hinge assembly includes a mounting base coupler, a lid coupler, a first hinge member, and a second hinge member. The mounting base coupler is coupled to the body top surface. The lid coupler is coupled to the lid. The first hinge member is coupled to the mounting base coupler and the lid coupler. The second hinge member is coupled to the mounting base coupler and the lid coupler. The lid covers the bowl when the hinge assembly is in the second position.

19 Claims, 14 Drawing Sheets

(56) References Cited

U.S. PATENT DOCUMENTS

| | | | | |
|---|---|---|---|---|
| 5,664,286 | A | 9/1997 | Sorimachi | |
| 5,742,949 | A | 4/1998 | Goldi et al. | |
| 6,026,520 | A | 2/2000 | Pedersen | |
| 6,775,858 | B1 | 8/2004 | Miller | |
| 7,003,851 | B2 * | 2/2006 | Salice | E05D 11/1021 16/285 |
| 8,082,604 | B2 | 12/2011 | Isaac | |
| 8,087,103 | B2 | 1/2012 | Leibfried | |
| 8,266,730 | B2 | 9/2012 | Ricca | |
| 8,677,568 | B2 * | 3/2014 | Sutterlutti | E05F 5/006 16/354 |
| 10,060,169 | B2 * | 8/2018 | Chen | E05D 7/0415 |
| 2015/0190019 | A1 * | 7/2015 | Pakosta | A47K 13/26 4/236 |
| 2017/0150854 | A1 * | 6/2017 | Tsujita | A47K 13/12 |

* cited by examiner

HINGE ASSEMBLY FOR TOILET

CROSS-REFERENCE TO RELATED PATENT APPLICATIONS

The present application claims the benefit of, and priority to, U.S. Provisional Patent Application No. 62/696,008, filed Jul. 10, 2018, and U.S. Provisional Patent Application No. 62/713,045, filed Aug. 1, 2018, the contents of which are incorporated herein by reference in their entireties.

BACKGROUND

The present application relates generally to a hinge for a lid.

A lid may be attached to a toilet base using a hinge. The hinge facilitates rotation of the lid relative to the toilet base. Many hinges include two hinge members disposed on opposite sides of one edge of the lid. Each of these hinge members is attached to the lid and the toilet base and facilitates rotation of the lid about a single axis.

There are significant aesthetic and functional drawbacks associated with such a hinge. For example, the shape of the lid may be constrained to certain shapes having a relatively flat edge to which the hinge members are attached. Additionally, the lid may be separated from surrounding structures, such as a toilet tank, by a significant distance so as to facilitate rotation of the lid about the single axis without interfering with the surrounding structures. This distance causes an increase in the overall size of the toilet which consequentially causes the toilet to be more expensive and have a larger space claim.

SUMMARY

One embodiment relates to a toilet. The toilet includes a body, a lid assembly, and a hinge assembly. The body includes a bowl and a body top surface. The body top surface is contiguous with the bowl. The lid assembly includes a lid. The lid is configured to cover the bowl. The hinge assembly is operable between a first position and a second position. The hinge assembly includes a mounting base coupler, a lid coupler, a first hinge member, and a second hinge member. The mounting base coupler is coupled to the body top surface. The lid coupler is coupled to the lid. The first hinge member is coupled to the mounting base coupler and the lid coupler. The second hinge member is coupled to the mounting base coupler and the lid coupler. The first hinge member and the second hinge member are configured to rotate relative to the mounting base coupler as the hinge assembly transitions between the first position and the second position. The lid covers the bowl when the hinge assembly is in the second position.

Another embodiment relates to a hinge assembly for a toilet having a body and a lid and operable between a first position and a second position. The hinge assembly includes a mounting base coupler, a lid coupler, a first hinge member, and a second hinge member. The mounting base coupler is configured to be coupled to the body. The lid coupler is configured to be coupled to the lid. The first hinge member is coupled to the mounting base coupler and the lid coupler. The second hinge member is coupled to the mounting base coupler and the lid coupler. The first hinge member and the second hinge member are configured to rotate relative to the mounting base coupler as the hinge assembly transitions between the first position and the second position. The first hinge member and the second hinge member are configured to rotate in opposite rotational directions as the hinge assembly transitions between the first position and the second position.

Yet another embodiment relates to a toilet. The toilet includes a body, a lid assembly, and a hinge assembly. The body includes a bowl and a body top surface. The body top surface is contiguous with the bowl. The lid assembly includes a lid. The lid is configured to cover the bowl. The hinge assembly is operable between a first position and a second position. The hinge assembly includes a mounting base coupler, a lid coupler, a first hinge member, a first hinge pin, and a third hinge pin. The mounting base coupler is coupled to the body top surface and includes a mounting base coupler first bore. The lid coupler is coupled to the lid and includes a lid coupler first bore. The first hinge member is coupled to the mounting base coupler and the lid coupler and includes a first hinge member first bore and a first hinge member second bore. The first hinge pin is positioned within the first hinge member first bore and the mounting base coupler first bore. The third hinge pin is positioned within the first hinge member second bore and the lid coupler first bore. The first hinge member is configured to rotate relative to the mounting base coupler as the hinge assembly transitions between the first position and the second position. The lid covers the bowl when the hinge assembly is in the second position. The first hinge pin is parallel to the third hinge pin.

DETAILED DESCRIPTION

Before turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

I. Overview

Embodiments herein are generally directed to a toilet that includes a hinge assembly that facilitates opening and closing of a lid of the toilet such that a space claim of the toilet may be reduced. The hinge assembly described herein includes a mounting base coupler that is attached to a mounting base or body of the toilet and a lid coupler that is attached to the lid. The hinge assembly also includes at least one hinge member that is attached to both the mounting base coupler and the lid coupler and that facilitates rotation of the lid relative to the mounting base or body. The movement of the hinge assembly (i.e., forward and upwards) can bypass various obstructions and provide more lid layback (i.e., the amount that a distal end of a lid may rotate backwards towards a wall or toilet tank). For example, if a toilet is designed such that the rear surface of a toilet seat and lid are mounted very close to a toilet tank disposed behind the lid, the lid with a conventional hinge might not be able to open the entire way (i.e., greater than 90 degrees) before contacting the tank. Gravity may cause the lid to fall or close from such an open position. However, with the hinge assembly described herein, the rotation of the hinge assembly effectively causes the lid to move forward, allowing for more lid layback (i.e., the lid may open greater than 90 degrees) without contacting the tank. This additional lid layback allows the lid to remain open, such that it will not fall to a closed position due to gravity. In addition, the compact configuration of the hinge assembly may help with bypassing Americans with Disabilities Act compliant grab bars behind the toilet or any other obstruction.

II. The Toilet Having the Hinge Assembly

Figure 1:
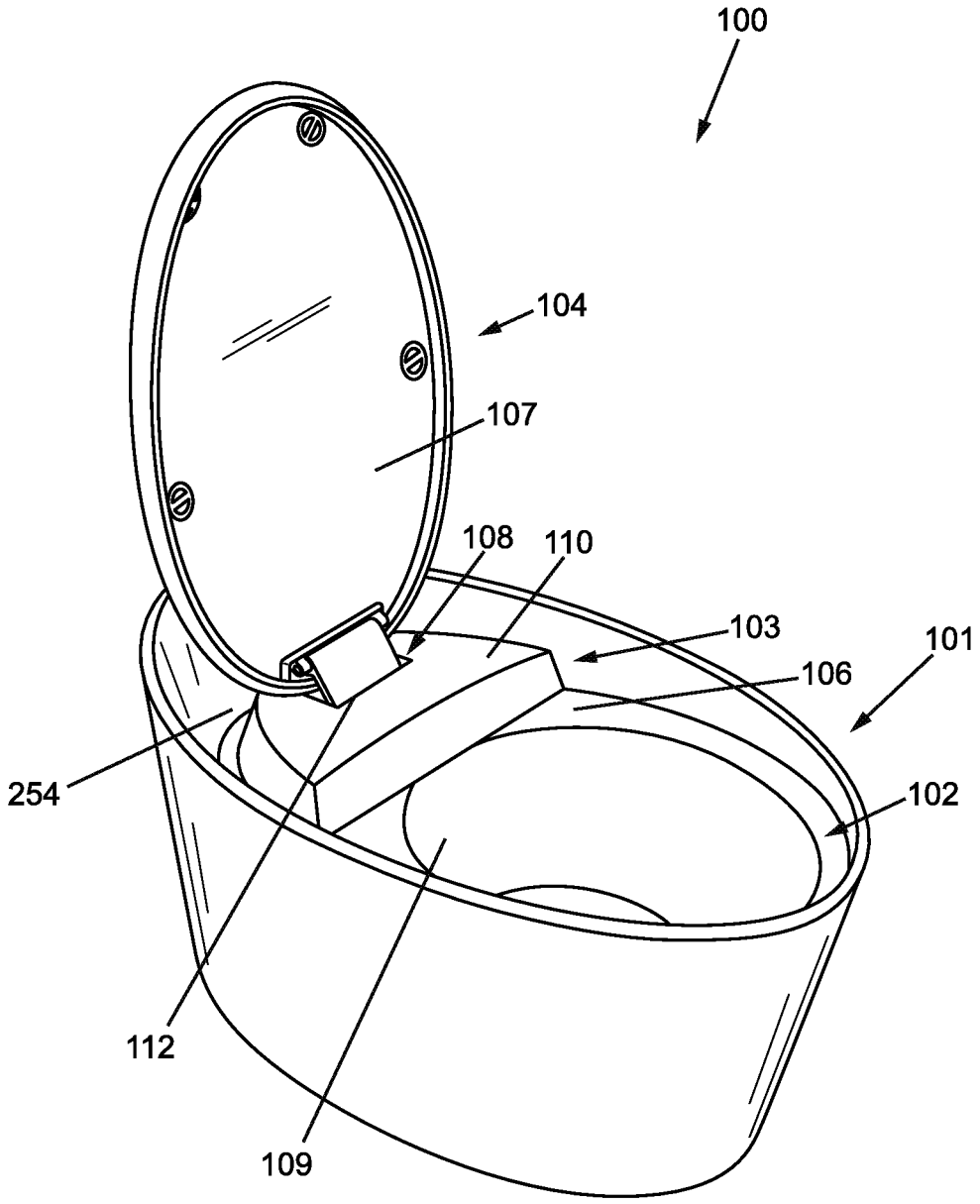
FIG. 1 is a perspective view of a toilet having a hinge assembly, according to an exemplary embodiment of the present disclosure.
Figure 2:
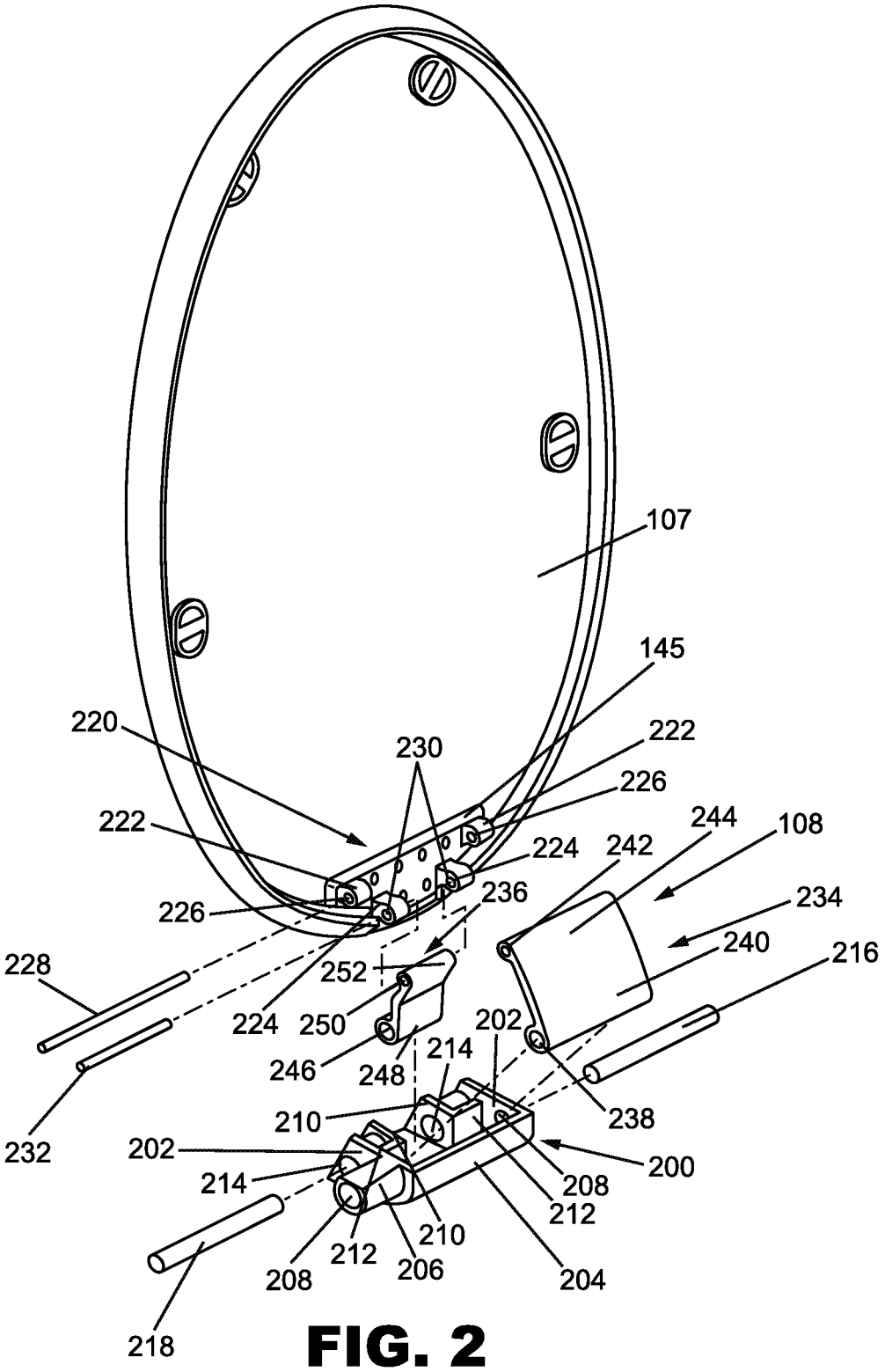
FIG. 2 is an exploded perspective view of a portion of the toilet shown in FIG. 1.
Figure 3:
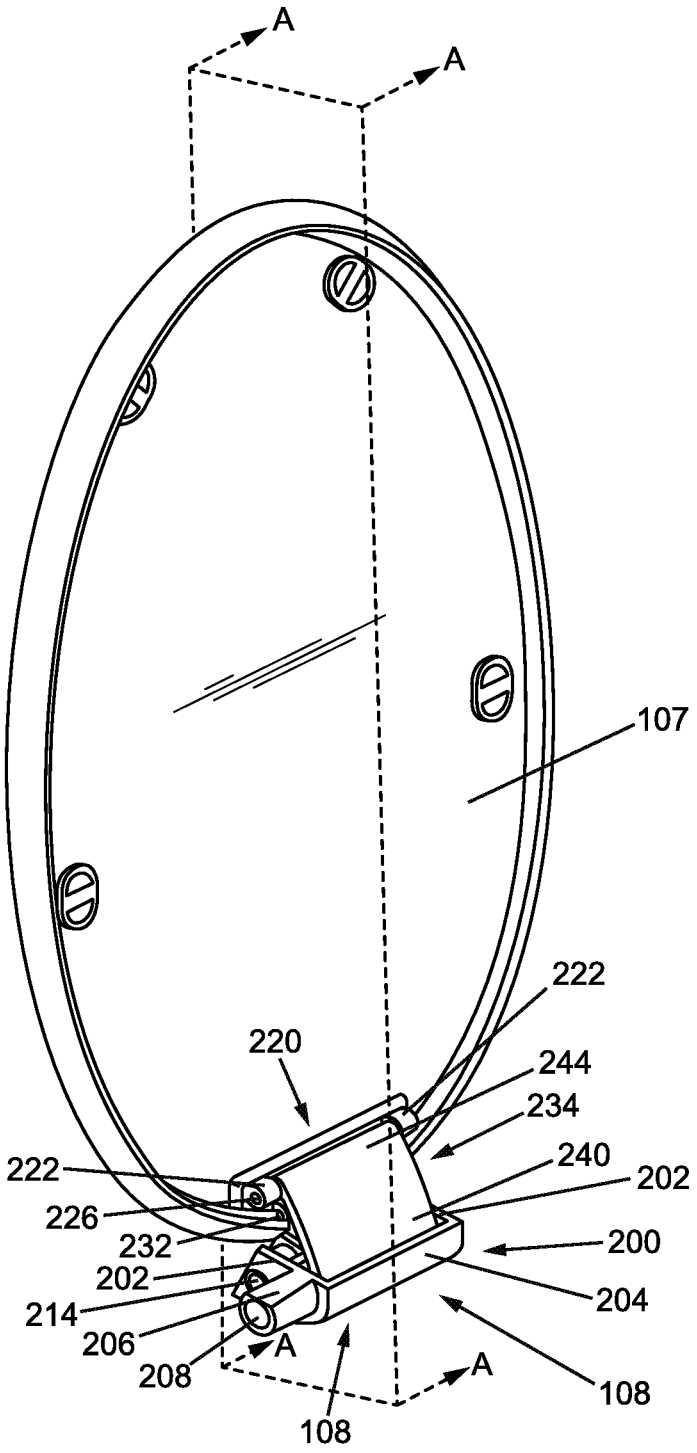
FIG. 3 is a perspective view of a portion of the toilet shown in FIG. 1.
Figure 4:
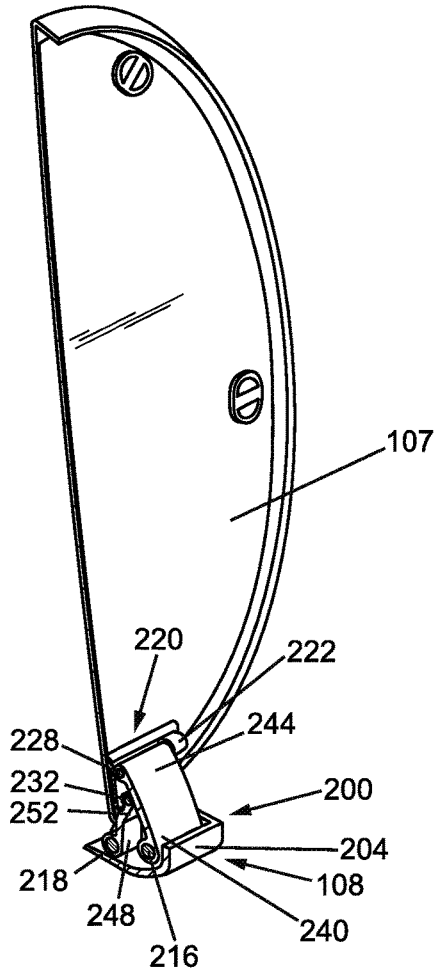
FIG. 4 is a perspective cross-sectional view of the portion of the toilet shown in FIG. 3 taken about plane A-A.

Referring to FIG. 1, a toilet 100 (e.g., commode, tankless toilet, etc.) is shown, according to an exemplary embodiment. The toilet 100 selectively receives waste (e.g., urine, feces, etc.) from a user (e.g., human, etc.) and selectively provides the waste to a sewage system (e.g., septic system, etc.). The toilet 100 may be installed in a user's home and/or in a commercial application, such as in a commercial building (e.g., office building, mall, etc.) or an industrial building.

The toilet 100 includes a base assembly 101 (e.g., support, etc.). The base assembly 101 is supported on a surface (e.g., floor, ground, tile floor, etc.). The base assembly 101 includes a body 102, a mounting base 103 (e.g., mounting assembly, etc.), and a lid assembly 104. The mounting base 103 is coupled to (e.g., attached to, affixed to, glued to, structurally integrated with, etc.) the body 102 along a body top surface 106 (e.g., face, deck, ledge, etc.) of the body 102.

The lid assembly 104 includes a lid 107 (e.g., cover, etc.). The lid 107 is coupled to the mounting base 103 via a hinge assembly 108 (e.g., hinge system, coupling system, single hinge, attachment system, etc.). The hinge assembly 108 is coupled to the mounting base 103. In some embodiments, the hinge assembly 108 is at least partially received within (e.g., contained in, positioned in, etc.) the mounting base 103. In various embodiments, the lid 107 is coupled to the mounting base 103 only via the hinge assembly 108 (e.g., the lid 107 is not coupled to the mounting base 103 using two hinge assemblies 108, the lid 107 is not coupled to the mounting base 103 using the hinge assembly 108 and another hinge, etc.).

The body 102 includes a bowl 109 (e.g., basin, etc.). The bowl 109 is contiguous with the body top surface 106. In operation, the bowl 109 receives waste from the user (e.g., human, etc.) and selectively provides the waste to a sewage system (e.g., septic system, etc.). The bowl 109 may also receive water from a water source (e.g., water supply, etc.) for facilitating removal of the waste from the bowl 109.

Figure 5:
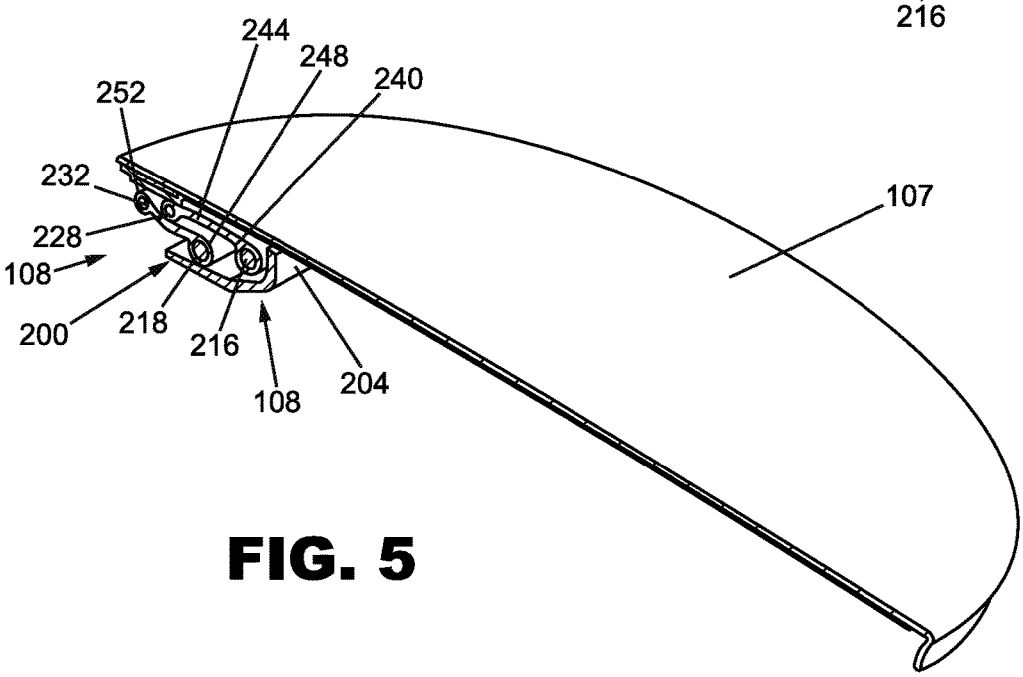
FIG. 5 is another perspective cross-sectional view of the portion of the toilet shown in FIG. 3 taken about plane A-A.
Figure 6:
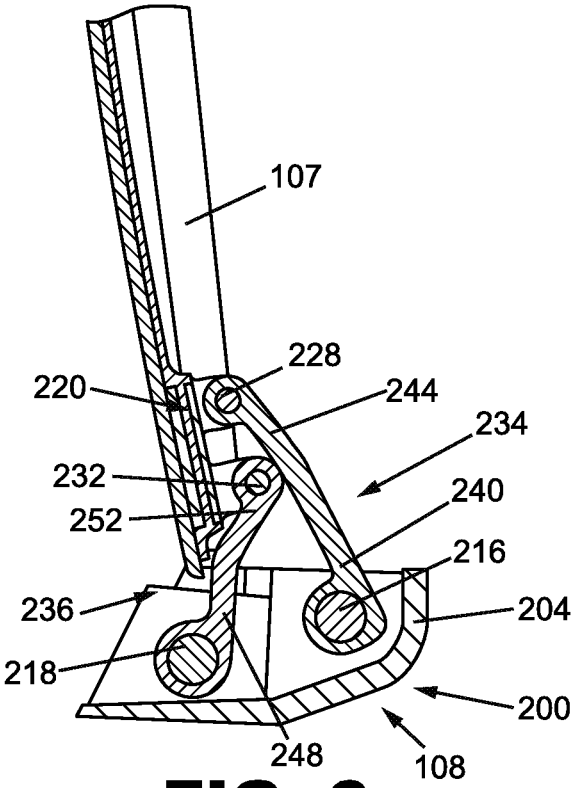
FIG. 6 is a cross-sectional view of the portion of the toilet shown in FIG. 3 taken about plane A-A.
Figure 7:
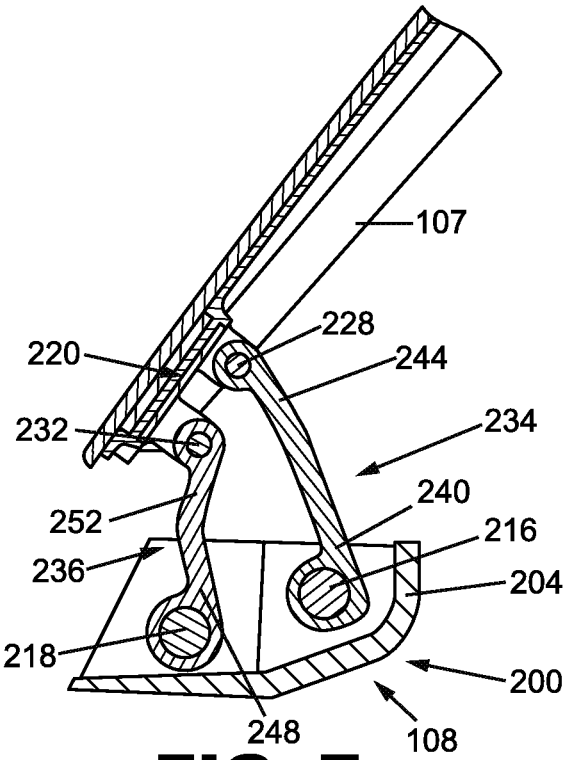
FIG. 7 is another cross-sectional view of the portion of the toilet shown in FIG. 3 taken about plane A-A.
Figure 8:
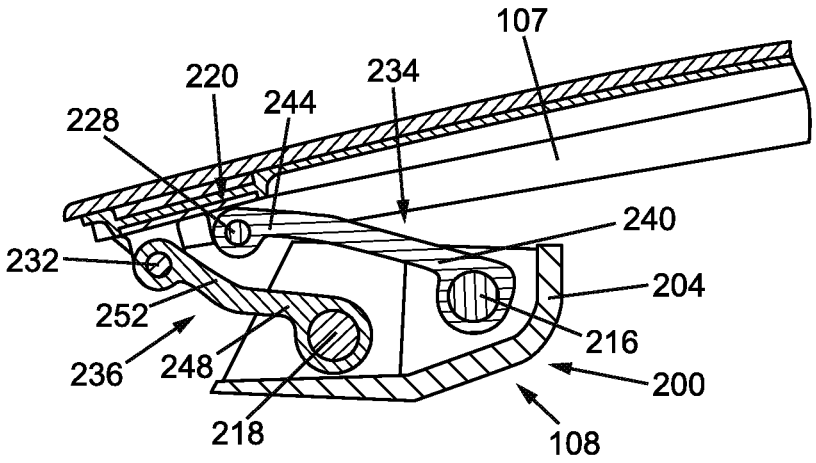
FIG. 8 is yet another cross-sectional view of the portion of the toilet shown in FIG. 3 taken about plane A-A.
Figure 9:
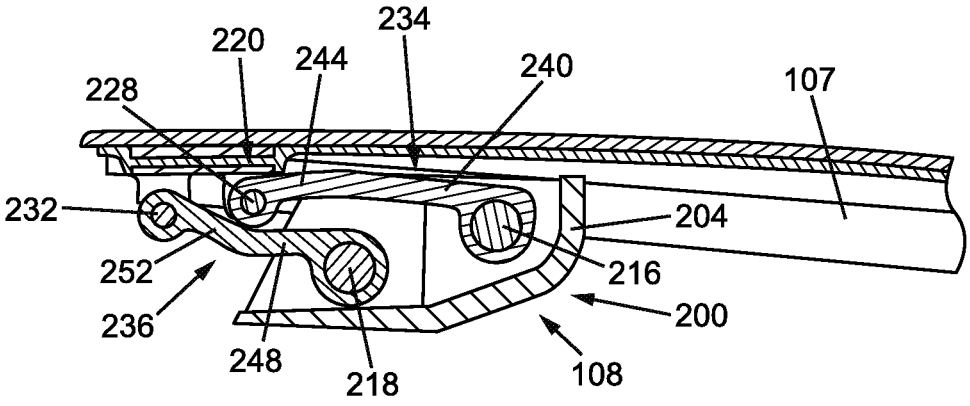
FIG. 9 is yet another cross-sectional view of the portion of the toilet shown in FIG. 3 taken about plane A-A.

The hinge assembly 108 facilitates movement of the lid 107 relative to the mounting base 103. The hinge assembly 108 is operable between a first position (e.g., open position, use position, etc.) and a second position (e.g., closed position, resting position, storing position, etc.). When the hinge assembly 108 is in the first position, such as is shown in FIG. 1, FIG. 3, FIG. 4, and FIG. 6, the bowl 109 is exposed (e.g., the lid 107 does not cover the bowl 109 when the hinge assembly 108 is in the first position, etc.). As a result, waste may be deposited into the bowl 109. However, when the hinge assembly 108 is in the second position, such as is shown in FIG. 5 and FIG. 9, the bowl 109 is covered by the lid 107 (e.g., the lid 107 is configured to cover the bowl 109 when the hinge assembly 108 is in the second position, etc.). As a result, waste may not be deposited into the bowl 109. FIGS. 7 and 8 illustrate the hinge assembly 108 at intermediate positions between the first position and the second position. When the hinge assembly 108 is in the first position, the lid 107 is separated from the body top surface by an angle. In various embodiments, this angle is between 90 degrees and 120 degrees, inclusive. In some applications, this angle is equal to 90 degrees, 95 degrees, 100 degrees, 105 degrees, 110 degrees, 115 degrees, 120 degrees, or other similar values.

The mounting base 103 is disposed directly behind the bowl 109. In some embodiments, the mounting base 103 is contiguous with the bowl 109. The mounting base 103 includes a mounting base top surface 110 (e.g., face, deck, ledge, etc.). The mounting base top surface 110 may be disposed along a plane that is parallel to a plane upon which the body top surface 106 is disposed.

The mounting base top surface 110 is raised relative to the body top surface 106. A mounting base cavity (e.g., void, etc.) is formed between the mounting base top surface 110 and the body top surface 106. The mounting base top surface 110 includes a mounting base aperture 112 (e.g., hole, opening, etc.). The mounting base aperture 112 provides access into the mounting base cavity through the mounting base top surface 110. The mounting base aperture 112 may be centered on (e.g., aligned with a center point of, etc.) the bowl 109.

The hinge assembly 108 is coupled to the mounting base 103 underneath the mounting base top surface 110 and proximate the mounting base aperture 112. When the hinge assembly 108 is in the first position, a portion of the hinge assembly 108 protrudes through the mounting base aperture 112. However, when the hinge assembly 108 is in the second position, the hinge assembly 108 is concealed within the mounting base 103. In addition to covering the mounting base aperture 112, thereby mitigating ingress of debris into the mounting base aperture 112 and protecting the hinge assembly 108, the lid 107 may be disposed along a plane that is parallel to a plane upon which the mounting base top surface 110 is disposed.

The hinge assembly 108 includes a mounting base coupler 200 (e.g., body, etc.). In some embodiments, the mounting base coupler 200 is coupled to the mounting base 103. For example, the mounting base coupler 200 may be coupled to the mounting base top surface 110. In other embodiments, the mounting base coupler 200 is coupled to the body 102. For example, the mounting base coupler 200 may be coupled to the body top surface 106.

The mounting base coupler 200 includes at least one mounting base coupler outer sidewall 202. Each of the mounting base coupler outer sidewalls 202 extends a depth of the mounting base coupler 200. In some embodiments, the mounting base coupler outer sidewalls 202 are parallel (e.g., one mounting base coupler outer sidewall 202 is disposed along a plane that is parallel to a plane upon which the other mounting base coupler outer sidewall 202 is disposed, etc.). The mounting base coupler 200 also includes a mounting base coupler front wall 204. The mounting base coupler front wall 204 is coupled to each of the mounting base coupler outer sidewalls 202.

The mounting base coupler 200 also includes at least one outwardly extending protrusion 206 (e.g., projection, etc.). Each protrusion 206 extends laterally from one of the mounting base coupler outer sidewalls 202. In some embodiments, the mounting base coupler 200 includes two protrusions 206, one protrusion 206 extending laterally from one of the mounting base coupler outer sidewalls 202 and the other protrusion 206 extending laterally from the other of the mounting base coupler outer sidewalls 202. Each protrusion 206 has a substantially cylindrical shape and can be received within a bore of the mounting base 103, so as to mount the mounting base coupler 200 within the mounting base 103. In this way, the hinge assembly 108 may be rotatably coupled to the body 102.

The mounting base coupler 200 also includes a mounting base coupler first bore 208 (e.g., hole, opening, aperture, etc.). The mounting base coupler first bore 208 extends through the protrusion 206 and each of the mounting base coupler outer sidewalls 202. In some embodiments, the mounting base coupler first bore 208 is orthogonal to one of the mounting base coupler outer sidewalls 202. It is understood that the mounting base coupler first bore 208 includes a plurality of bore segments (e.g., a first segment within the protrusion 206, a second segment within one of the mounting base coupler outer sidewalls 202, a third segment within the other of the mounting base coupler outer sidewalls 202, etc.).

The mounting base coupler 200 also includes at least one mounting base coupler inner sidewall 210. Each of the mounting base coupler inner sidewalls 210 extends a portion of the depth of the mounting base coupler 200. Each of the mounting base coupler inner sidewalls 210 is separated from the mounting base coupler front wall 204. In some embodiments, the mounting base coupler inner sidewalls 210 are parallel (e.g., one mounting base coupler inner sidewall 210 is disposed along a plane that is parallel to a plane upon which the other mounting base coupler inner sidewall 210 is disposed, etc.). Each of the mounting base coupler inner sidewalls 210 may be parallel to one of the mounting base coupler outer sidewalls 202.

The mounting base coupler 200 also includes at least one mounting base coupler connecting wall 212. Each of the mounting base coupler connecting walls 212 extends between one of the mounting base coupler inner sidewalls 210 and one of the mounting base coupler outer sidewalls 202. In some embodiments, the mounting base coupler connecting walls 212 are each orthogonal to one of the mounting base coupler outer sidewalls 202 and/or one of the mounting base coupler inner sidewalls 210. The mounting base coupler connecting walls 212 may be aligned (e.g., disposed along the same plane, etc.).

The mounting base coupler 200 also includes a mounting base coupler second bore 214 (e.g., hole, opening, aperture, etc.). The mounting base coupler second bore 214 extends through the each of the mounting base coupler outer sidewalls 202 and each of the mounting base coupler inner sidewalls 210. In some embodiments, the mounting base coupler second bore 214 is orthogonal to one of the mounting base coupler outer sidewalls 202. In some embodiments, the mounting base coupler second bore 214 is parallel to the mounting base coupler first bore 208. It is understood that the mounting base coupler second bore 214 includes a plurality of bore segments (e.g., a first segment within one of the mounting base coupler outer sidewalls 202, a second segment within one of the mounting base coupler inner sidewalls 210, a third segment within the other of the mounting base coupler inner sidewalls 210, a fourth segment within the other of the mounting base coupler outer sidewalls 202, etc.).

The mounting base coupler first bore 208 is configured to receive a first hinge pin 216 (e.g., rod, dowel, etc.) extending therethrough. The first hinge pin 216 extends laterally and has a substantially cylindrical shape. The mounting base coupler first bore 208 is sized to receive the first hinge pin 216. Similarly, the mounting base coupler second bore 214 is configured to receive a second hinge pin 218 (e.g., rod, dowel, etc.) extending therethrough. The second hinge pin 218 extends laterally and has a substantially cylindrical shape. The mounting base coupler second bore 214 is sized to receive the second hinge pin 218. The first hinge pin 216 and second hinge pin 218 may have similar dimensions (e.g., diameters, lengths, etc.).

The hinge assembly 108 also includes a lid coupler 220. The lid coupler 220 is coupled to the lid 107. The lid coupler 220 includes at least one first flange 222 (e.g., projection, etc.) and at least one second flange 224 (e.g., projection, etc.). In some embodiments, each of the first flanges 222 and each of the second flanges 224 is disposed at a lateral end of the lid coupler 220. In various embodiments, a distance between the first flanges 222 is greater than a distance between the second flanges 224. However, in other embodiments, a distance between the first flanges 222 is less than a distance between the second flanges 224. In still other embodiments, a distance between the first flanges 222 is equal to (e.g., within 5% of, etc.) a distance between the second flanges 224.

Each of the first flanges 222 includes a lid coupler first bore 226 (e.g., hole, opening, aperture, etc.). The lid coupler first bore 226 is configured to receive a third hinge pin 228. The third hinge pin 228 is shown to extend laterally between the first flanges 222 and has a substantially cylindrical shape. In some embodiments, the lid coupler first bore 226 is parallel to the mounting base coupler first bore 208 and/or the mounting base coupler second bore 214.

Each of the second flanges 224 includes a lid coupler second bore 230 (e.g., hole, opening, aperture, etc.). The lid coupler second bore 230 is configured to receive a fourth hinge pin 232. The fourth hinge pin 232 is shown to extend laterally between the second flanges 224 and has a substantially cylindrical shape. In some embodiments, the lid coupler second bore 230 is parallel to the mounting base coupler first bore 208 and/or the mounting base coupler second bore 214.

The hinge assembly 108 also includes a first hinge member 234 and a second hinge member 236. As will be explained in more detail herein, the first hinge member 234 is coupled and the second hinge member 236 are each coupled to the mounting base coupler 200 and the lid coupler 220 and facilitate transition of the hinge assembly 108 between the first position and the second position. The first hinge member 234 is shown to be oriented substantially vertically (e.g., greater than or equal to 45° and less than or equal to 90°) in FIG. 3. The second hinge member 236 is shown to be oriented substantially vertically (e.g., greater than or equal to 45° and less than or equal to 90°) in FIG. 3.

The first hinge member 234 includes a first hinge member first bore 238 (e.g., hole, opening, aperture, etc.). The first hinge member first bore 238 extends through a first hinge member first end 240 (e.g., terminal end, etc.) of the first hinge member 234. The first hinge member first bore 238 is configured to receive the first hinge pin 216. The first hinge member first end 240 is configured to be received between the mounting base coupler outer sidewalls 202. Through the first hinge pin 216, the first hinge member 234 may be rotatably coupled to the mounting base coupler 200.

In some embodiments, the first hinge member first bore 238 is sized to facilitate rotation of the first hinge member 234 about the first hinge pin 216. In some embodiments, the mounting base coupler first bore 208 is sized to facilitate rotation of the first hinge pin 216 within the mounting base coupler first bore 208. In some embodiments, the first hinge member first bore 238 is sized to facilitate rotation of the first hinge member 234 about the first hinge pin 216 and the mounting base coupler first bore 208 is sized to facilitate rotation of the first hinge pin 216 within the mounting base coupler first bore 208.

The first hinge member 234 also includes a first hinge member second bore 242 (e.g., hole, opening, aperture, etc.). The first hinge member second bore 242 extends through a first hinge member second end 244 (e.g., terminal end, etc.) of the first hinge member 234. The first hinge member second bore 242 is configured to receive the third hinge pin 228. In some embodiments, the first hinge member first bore 238 is parallel to the first hinge member second bore 242. The first hinge member second end 244 is configured to be received between the first flanges 222. Through the third hinge pin 228, the first hinge member 234 may be rotatably coupled to the lid coupler 220.

In some embodiments, the first hinge member second bore 242 is sized to facilitate rotation of the first hinge member 234 about the third hinge pin 228. In some embodiments, the lid coupler first bore 226 is sized to facilitate rotation of the third hinge pin 228 within the lid coupler first bore 226. In some embodiments, the first hinge member second bore 242 is sized to facilitate rotation of the first hinge member 234 about the third hinge pin 228 and the lid coupler first bore 226 is sized to facilitate rotation of the third hinge pin 228 within the lid coupler first bore 226.

The second hinge member 236 includes a second hinge member first bore 246 (e.g., hole, opening, aperture, etc.). The second hinge member first bore 246 extends through a second hinge member first end 248 (e.g., terminal end, etc.) of the second hinge member 236. The second hinge member first bore 246 is configured to receive the second hinge pin 218. The second hinge member first end 248 is configured to be received between the mounting base coupler inner sidewalls 210. Through the second hinge pin 218, the second hinge member 236 may be rotatably coupled to the mounting base coupler 200.

In some embodiments, the second hinge member first bore 246 is sized to facilitate rotation of the second hinge member 236 about the second hinge pin 218. In some embodiments, the mounting base coupler second bore 214 is sized to facilitate rotation of the second hinge pin 218 within the mounting base coupler second bore 214. In some embodiments, the second hinge member first bore 246 is sized to facilitate rotation of the second hinge member 236 about the second hinge pin 218 and the mounting base coupler second bore 214 is sized to facilitate rotation of the second hinge pin 218 within the mounting base coupler second bore 214.

The second hinge member 236 also includes a second hinge member second bore 250 (e.g., hole, opening, aperture, etc.). The second hinge member second bore 250 extends through a second hinge member second end 252 (e.g., terminal end, etc.) of the second hinge member 236. The second hinge member second bore 250 is configured to receive the fourth hinge pin 232. In some embodiments, the second hinge member first bore 246 is parallel to the second hinge member second bore 250. The second hinge member second end 252 is configured to be received between the second flanges 224. Through the fourth hinge pin 232, the second hinge member 236 may be rotatably coupled to the lid coupler 220.

In some embodiments, the second hinge member second bore 250 is sized to facilitate rotation of the second hinge member 236 about the fourth hinge pin 232. In some embodiments, the lid coupler second bore 230 is sized to facilitate rotation of the fourth hinge pin 232 within the lid coupler second bore 230. In some embodiments, the first hinge member second bore 242 is sized to facilitate rotation of the first hinge member 234 about the third hinge pin 228 and the lid coupler second bore 230 is sized to facilitate rotation of the fourth hinge pin 232 within the lid coupler second bore 230.

When installed, the mounting base coupler 200 may receive the first hinge member 234 and the second hinge member 236. When the hinge assembly 108 is in the first position, the first hinge member second end 244 may be slightly behind (e.g., offset from, etc.) the second hinge member first end 248, such that the first hinge member 234 is oriented partially at an angle (e.g., an obtuse angle relative to the body top surface 106, etc.). Similarly, the second hinge member second end 252 is slightly behind the second hinge member first end 248, such that the second hinge member is oriented partially at an angle (e.g., an acute angle relative to the body top surface 106, etc.) when the hinge assembly 108 is in the first position.

When the hinge assembly 108 is in the first position, the third hinge pin 228 is substantially vertically above the fourth hinge pin 232. Additionally, the third hinge pin 228 and the fourth hinge pin 232 are disposed between the first hinge pin 216 and the second hinge pin 218 (e.g., the second hinge pin 218 is further from the mounting base coupler front wall 204 than the third hinge pin 228 or the fourth hinge pin 232) when the hinge assembly 108 is in the first position.

As the hinge assembly 108 transitions from the first position to the second position, the first hinge member 234 and second hinge member 236 are rotated backwards and downwards, such that they are substantially parallel behind the mounting base coupler front wall 204. During rotation of the hinge assembly 108 from the first position to the second position, the first hinge member 234 and the second hinge member 236 initially rotate in different rotational directions (e.g., the first hinge member 234 rotates counter clockwise and the second hinge member 236 rotates clockwise, etc.) and subsequently rotate in the same rotational direction (e.g., clockwise, etc.) as the hinge assembly 108 approaches the second position.

When the hinge assembly 108 is in the second position, the third hinge pin 228 is disposed at substantially the same height and in front of the fourth hinge pin 232. Furthermore, both the fourth hinge pin 232 and the third hinge pin 228 may be disposed behind (e.g., further from the mounting base coupler front wall 204, etc.) the first hinge pin 216 and the second hinge pin 218. In this way, the axis of rotation of the hinge assembly 108 is effectively shifted away from the mounting base coupler front wall 204 as the hinge assembly 108 transitions from the first position to the second position, thus enabling the hinge assembly 108 to be mounted closer to a rear wall 254 (e.g., surface, etc.) of the body 102. This enables the toilet 100 to have a smaller space claim than other similar toilets (e.g., toilets that have a similar capability for processing waste as the toilet 100, etc.).

When the hinge assembly 108 is in the first position, the second hinge member 236 contacts a mechanical stop to prevent further movement of the second hinge member 236 towards the mounting base coupler front wall 204. This mechanical stop may be structurally integrated within the mounting base coupler 200, such as within the mounting base coupler inner sidewall 210. Additionally, this mechanical stop may be the first hinge member 234 or may be structurally integrated within the first hinge member 234.

When the hinge assembly 108 is in the second position, the second hinge member 236 may contact a mechanical stop to prevent further movement of the second hinge member 236 towards the body top surface 106. This mechanical stop may be structurally integrated within the mounting base coupler 200, such as within the mounting base coupler inner sidewall 210. Additionally, this mechanical stop may be provided through contact between the lid 107 and the mounting base coupler 200, contact between the lid 107 and the mounting base 103, and/or contact between the lid 107 and the body top surface 106.

The third hinge pin 228 is disposed vertically above the fourth hinge pin 232 when the hinge assembly 108 is in the first position. Similarly, the third hinge pin 228 and the fourth hinge pin 232 may be disposed horizontally between the first hinge pin 216 and second hinge pin 218 when the hinge assembly 108 is in the first position.

FIG. 7 shows the hinge assembly 108 beginning to transition from the first position to the second position, in which the axis of rotation shifts backward, such that the third hinge pin 228 is disposed more forward than the fourth hinge pin 232. In addition, the lower end of the lid 107 begins to shift backward (e.g., away from the mounting base coupler front wall 204, etc.).

FIG. 8 shows the hinge assembly 108 transitioned closer to the second position than in FIG. 7 and with the axis of rotation shifted even further back, resulting in the lid 107 being closed even further, and the lower end of the lid 107 being further backward (e.g., away from the mounting base coupler front wall 204, etc.). As this occurs, the fourth hinge pin 232 and the third hinge pin 228 shift further backwards (e.g., away from the mounting base coupler front wall 204, etc.), such that both the third hinge pin 228 and the fourth hinge pin 232 are disposed further away from the mounting base coupler front wall 204 than both of the first hinge pin 216 or the second hinge pin 218.

FIG. 9 shows the hinge assembly 108 in the second position with the lid 107 oriented generally horizontally (e.g., the lid 107 is disposed along a plane that is generally parallel to a plane upon which the body top surface 106 is disposed, etc.). The third hinge pin 228 and the fourth hinge pin 232 are about horizontally aligned (e.g., disposed at about the same distance from the body top surface 106, etc.), with the fourth hinge pin 232 more being further from the mounting base coupler front wall 204 than the third hinge pin 228 or the fourth hinge pin 232. The first hinge member 234 and the second hinge member 236 are also stacked horizontally between the mounting base coupler 200 and the lid 107.

In some embodiments, a damper (e.g., shock absorber, etc.) is coupled to the mounting base coupler 200 and the lid coupler 220 and configured to facilitate a gradual transition of the hinge assembly 108 from the first position to the second position. For example, the damper may enable a user to remove the hinge assembly 108 from the first position and cause the hinge assembly 108 to automatically transition to the second position (e.g., due to gravity, etc.). In other embodiments, such a damper may be incorporated into the first hinge pin 216, the second hinge pin 218, the third hinge pin 228, and/or the fourth hinge pin 232 instead of being coupled to the mounting base coupler 200 and the lid coupler 220.

In various embodiments, the mounting base 103 is coupled to the body top surface 106 such that the mounting base 103 is disposed in confronting relation with the rear wall 254. In various embodiments, the toilet 100 and body 102 each have a generally oblong shape, while the bowl 109 has a substantially circular cross section. In various embodiments, the bowl 109 is disposed in a forward portion of the body 102.

The lid assembly 104 can also include a toilet seat that is configured to allow a user to sit on the toilet seat while using the toilet 100. The toilet seat can be rotatably coupled to the lid assembly 104 and/or the base assembly 101. In some embodiments, the toilet seat is rotatably coupled to the lid 107 and/or body 102 via the hinge assembly 108.

Figure 10:
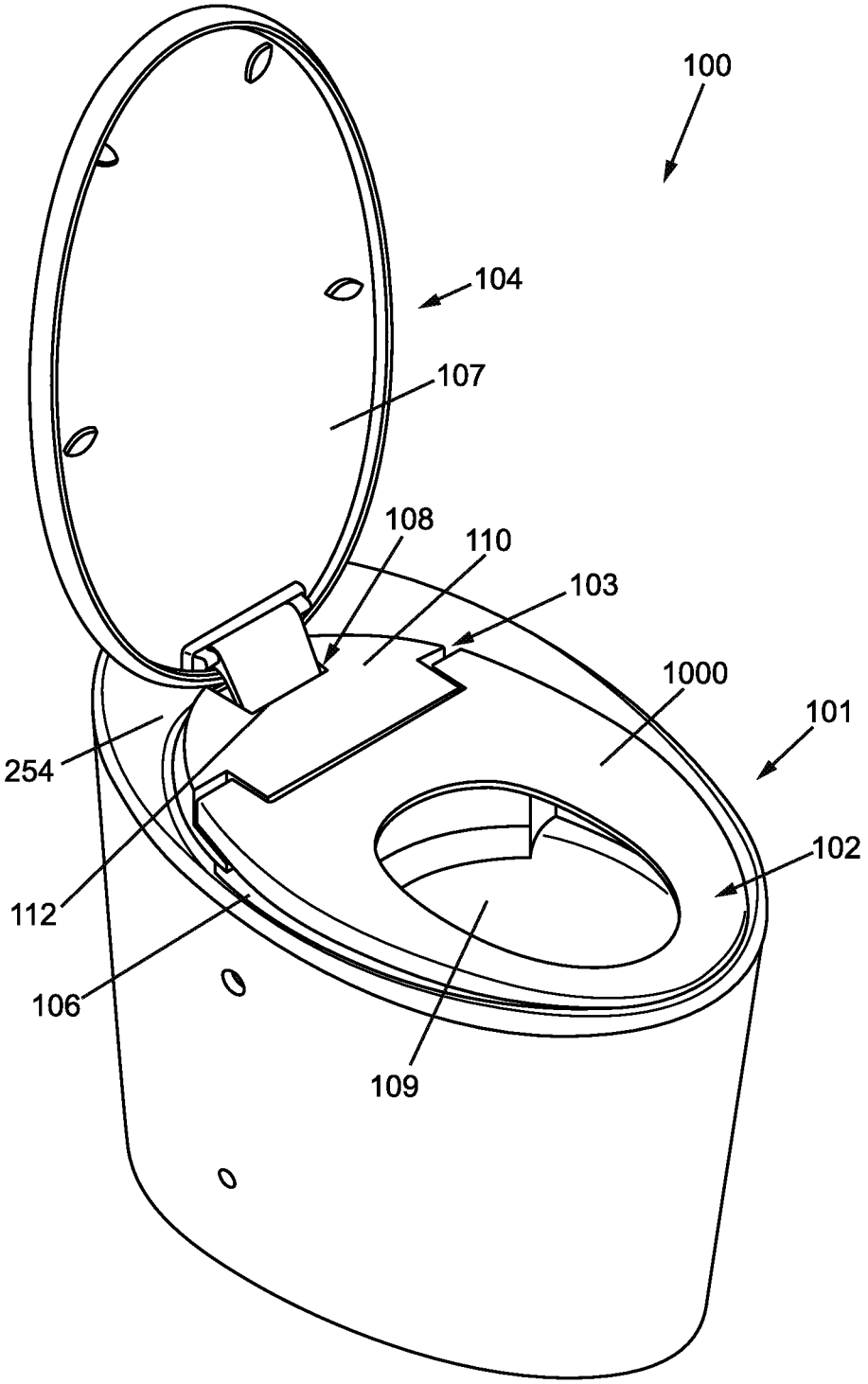
FIG. 10 is a perspective view of a toilet having a hinge assembly, according to an exemplary embodiment of the present disclosure.

FIGS. 10-18 illustrate the toilet 100 according to various embodiments. As shown in FIG. 10, the distance between the mounting base top surface 110 and the body top surface 106 is less than the distance between the mounting base top surface 110 and the body top surface 106 in FIG. 1. Additionally, FIG. 10 illustrates the toilet 100 including a toilet seat 1000 (e.g., seat, etc.). The toilet seat 1000 is coupled to the mounting base 103 and is configured to rest upon the body top surface 106. In some embodiments, the toilet seat 1000 is rotatably coupled to the mounting base 103 separate from the lid assembly 104 (e.g., such that the toilet seat 1000 may be articulated independent of the lid assembly 104, etc.). In various embodiments, the toilet seat 1000 is not coupled to the hinge assembly 108.

Figure 11:
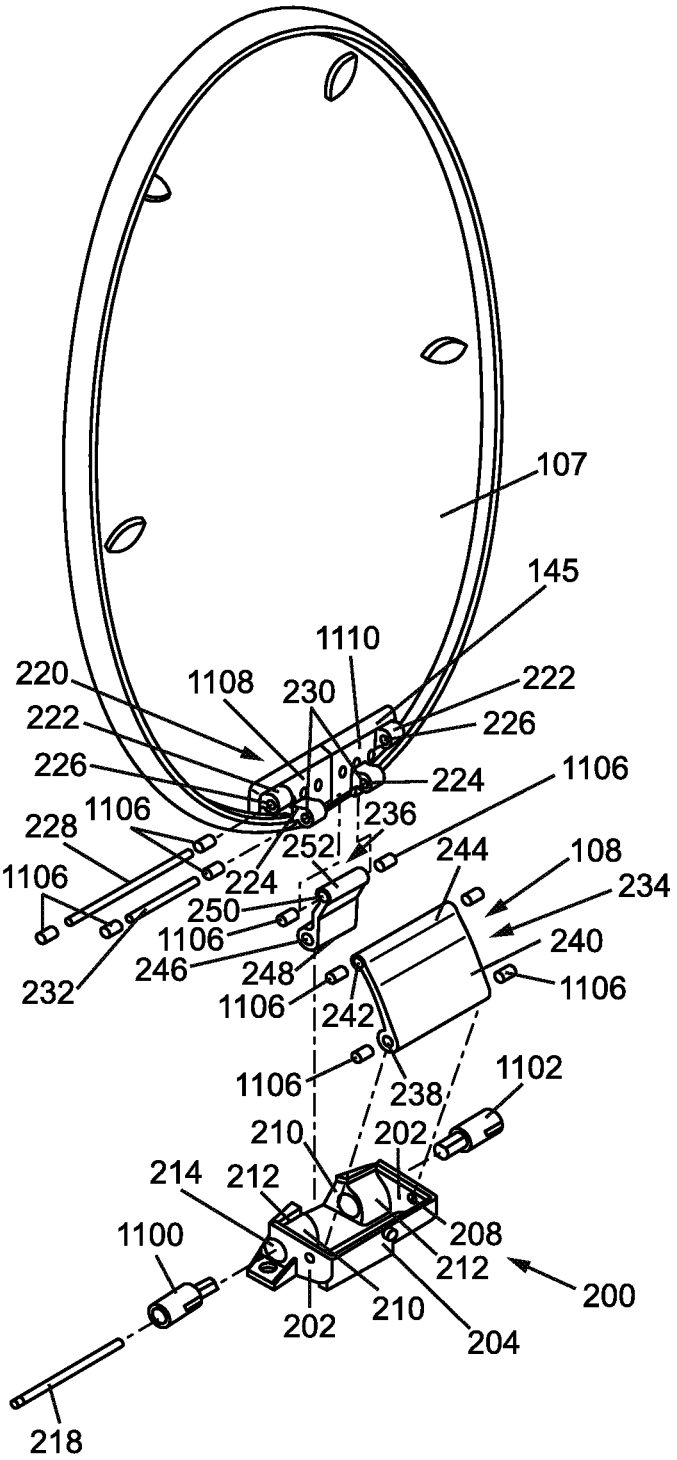
FIG. 11 is an exploded perspective view of a portion of the toilet shown in FIG. 10.
Figure 12:
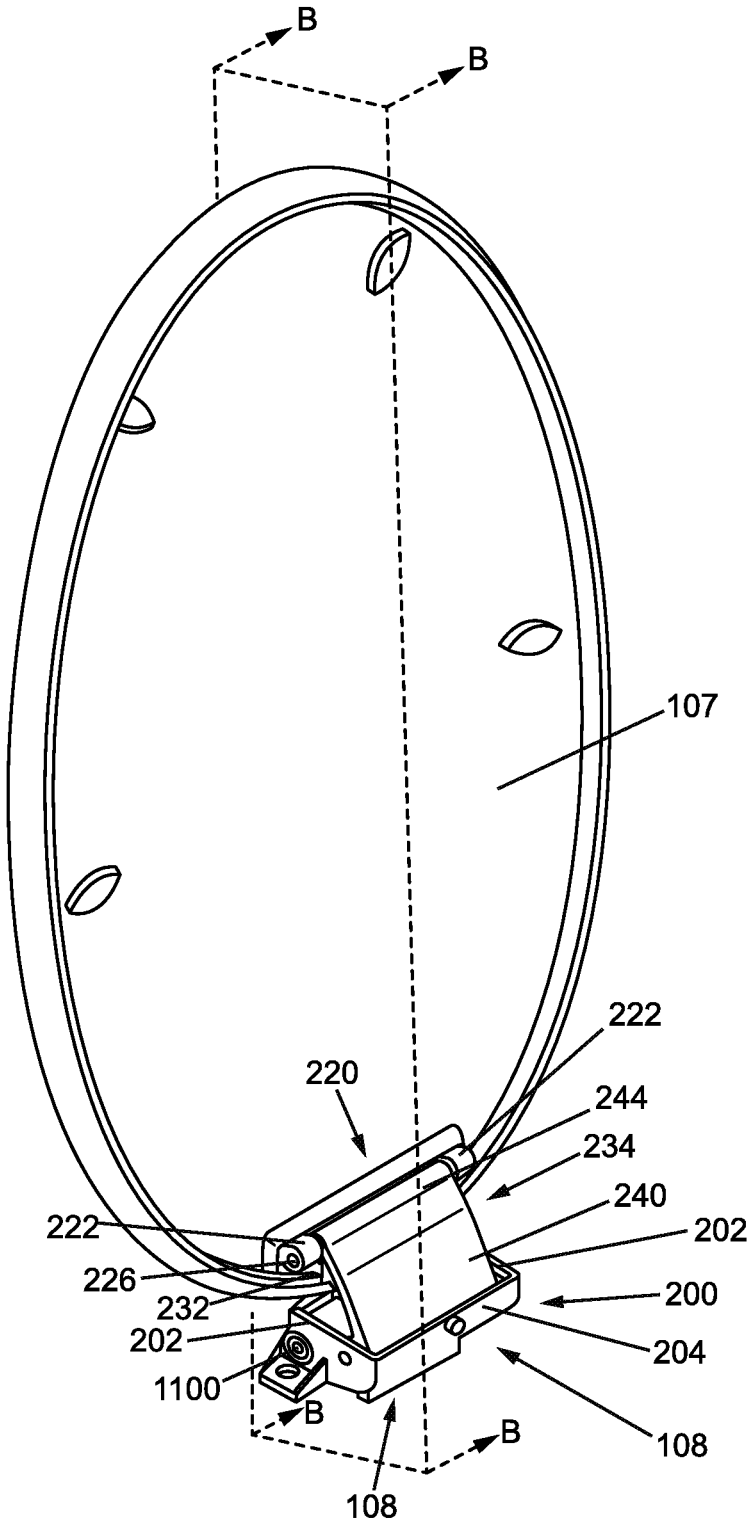
FIG. 12 is a perspective view of a portion of the toilet shown in FIG. 10.
Figure 13:
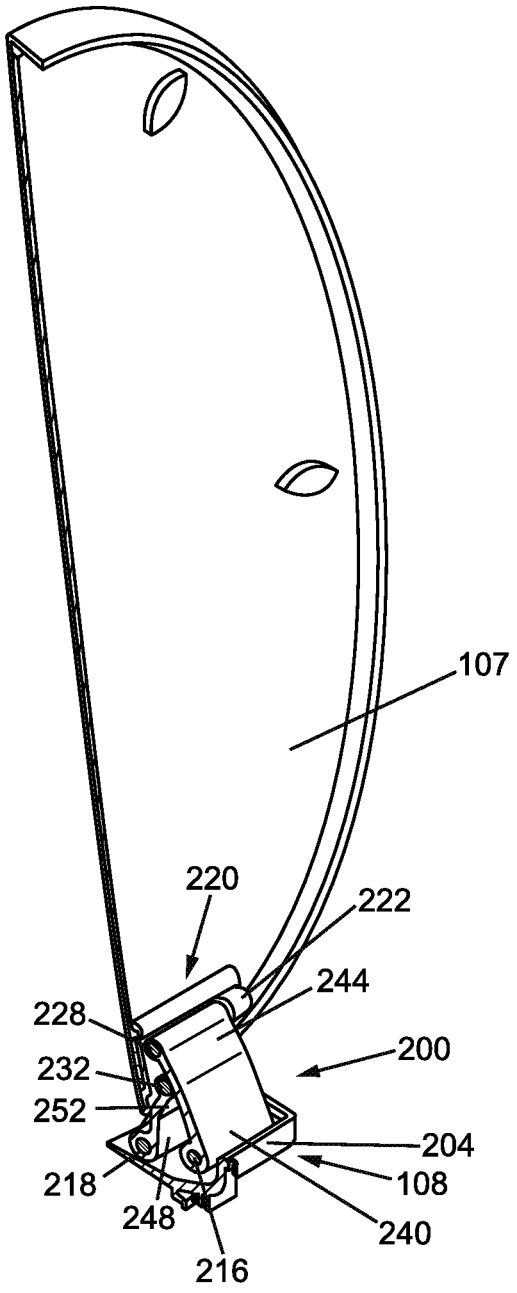
FIG. 13 is a perspective cross-sectional view of the portion of the toilet shown in FIG. 12 taken about plane B-B.
Figure 14:
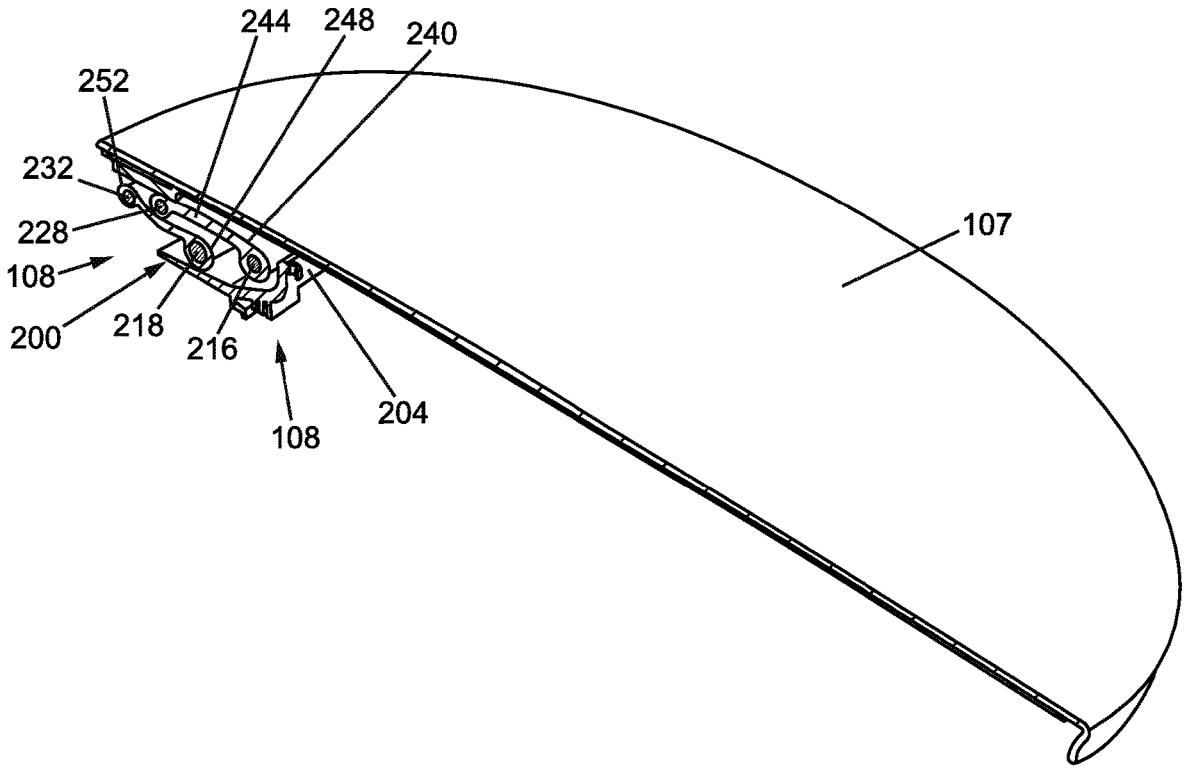
FIG. 14 is another perspective cross-sectional view of the portion of the toilet shown in FIG. 12 taken about plane B-B.

As shown in FIG. 11, the toilet 100 does not include the protrusion 206. As a result, the mounting base coupler first bore 208 extends only through each of the mounting base coupler outer sidewalls 202.

As also shown in FIG. 11, the hinge assembly 108 includes a first damper 1100 (e.g., shock absorber, etc.) and a second damper 1102 (e.g., shock absorber, etc.). The first damper 1100 and the second damper 1102 are received within the mounting base coupler second bore 214 and are configured to receive the second hinge pin 218 (e.g., such that the second hinge pin 218 is received within the mounting base coupler second bore 214, etc.). The first damper 1100 and the second damper 1102 are each configured to facilitate a gradual transition of the hinge assembly 108 from the first position to the second position by resisting rotation of the second hinge pin 218 within the mounting base coupler second bore 214.

As also shown in FIG. 11, the hinge assembly 1108 may include sleeve bushings 1106 (e.g., sleeves, covers, etc.) disposed on ends of each of the first hinge pin 216, the second hinge pin 218, the third hinge pin 228, and/or the fourth hinge pin 232 so as to prevent wear of the first hinge pin 216, the second hinge pin 218, the third hinge pin 228, and/or the fourth hinge pin 232.

As also shown in FIG. 11, the lid coupler 220 may be divided into a first lid coupler portion 1108 and a second lid coupler portion 1110. By dividing the lid coupler 220 into the first lid coupler portion 1108 and the second lid coupler portion 1110, installation of the lid coupler 220 may be simplified. The first lid coupler portion 1108 may be symmetrical to the second lid coupler portion 1110.

Figure 15:
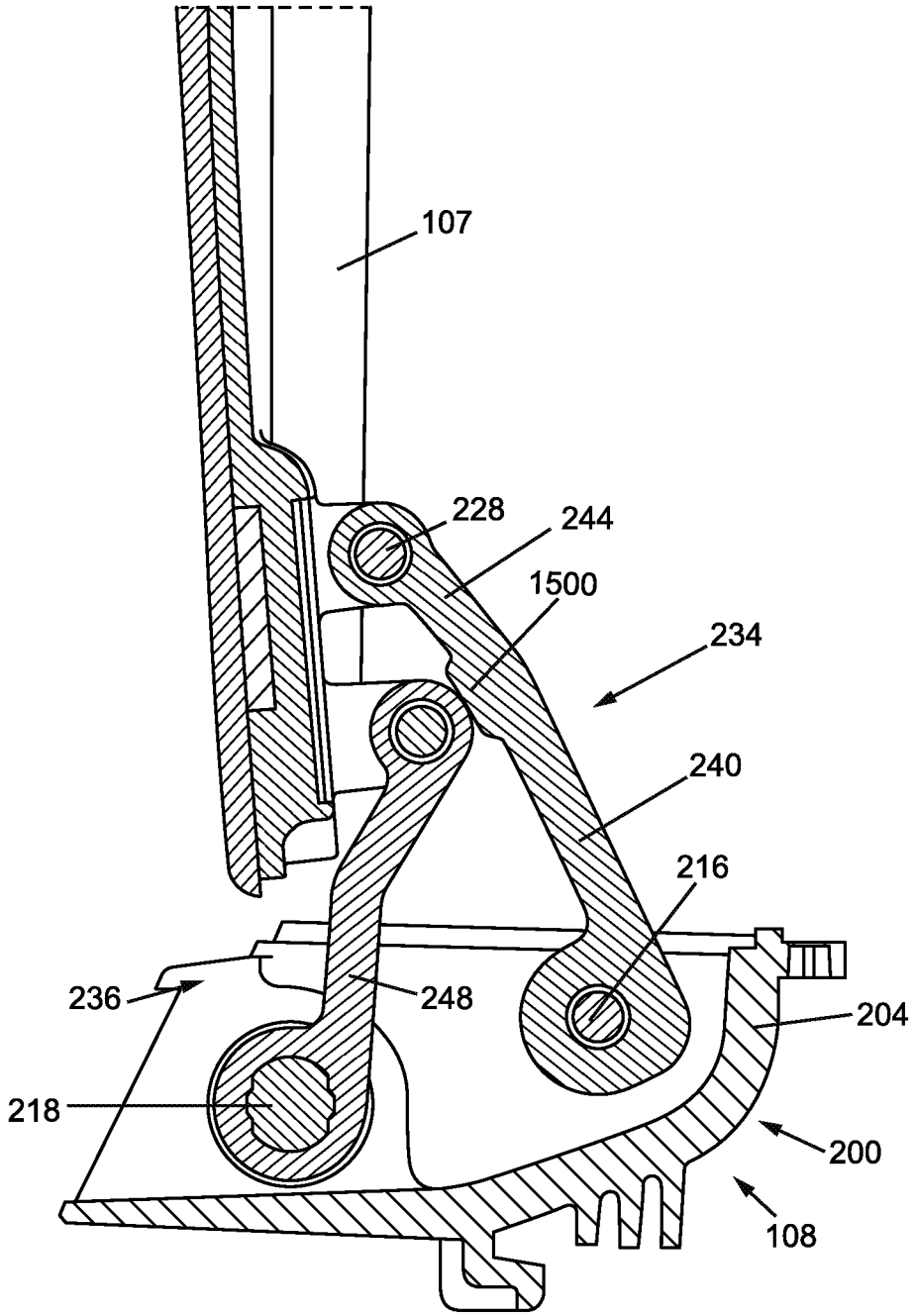
FIG. 15 is a cross-sectional view of the portion of the toilet shown in FIG. 12 taken about plane B-B.
Figure 16:
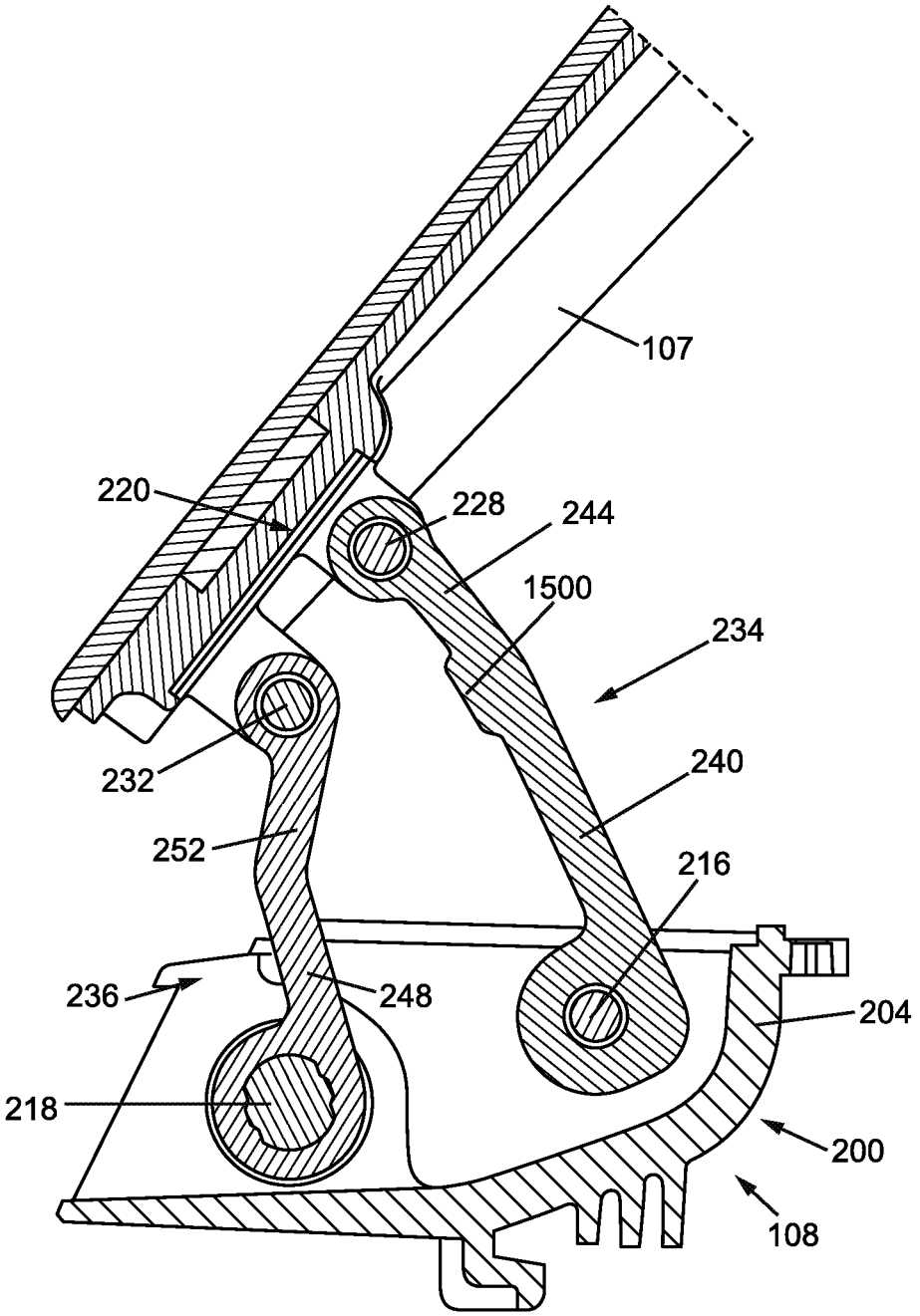
FIG. 16 is another cross-sectional view of the portion of the toilet shown in FIG. 12 taken about plane B-B.
Figure 17:
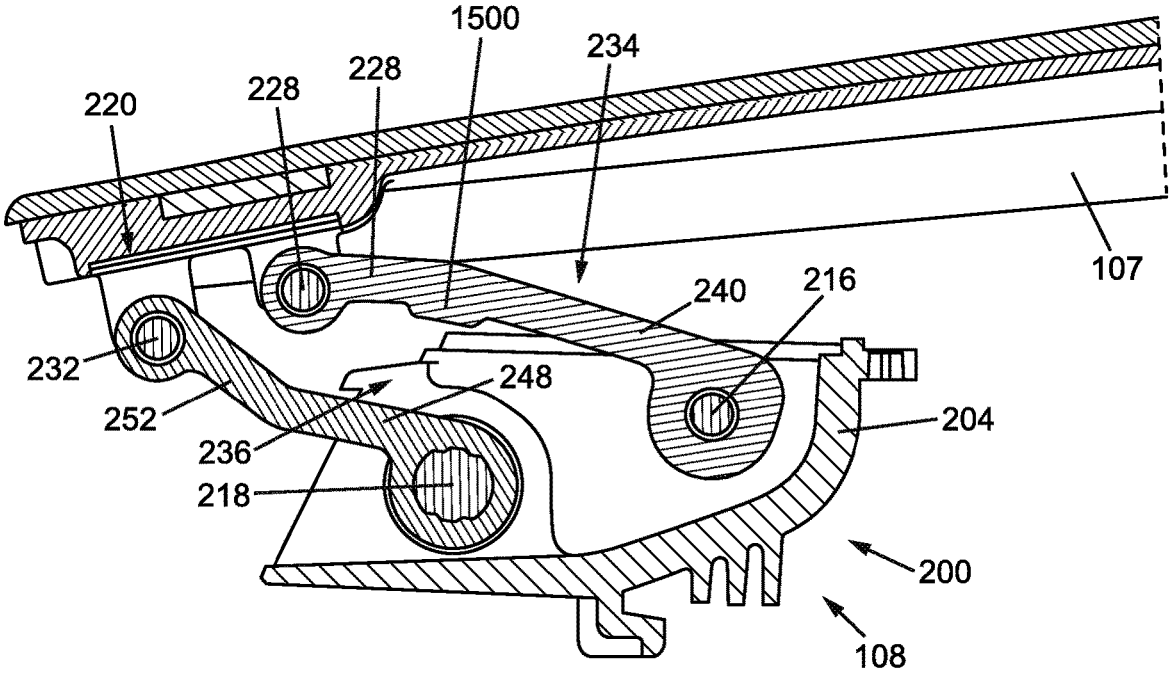
FIG. 17 is yet another cross-sectional view of the portion of the toilet shown in FIG. 12 taken about plane B-B.
Figure 18:
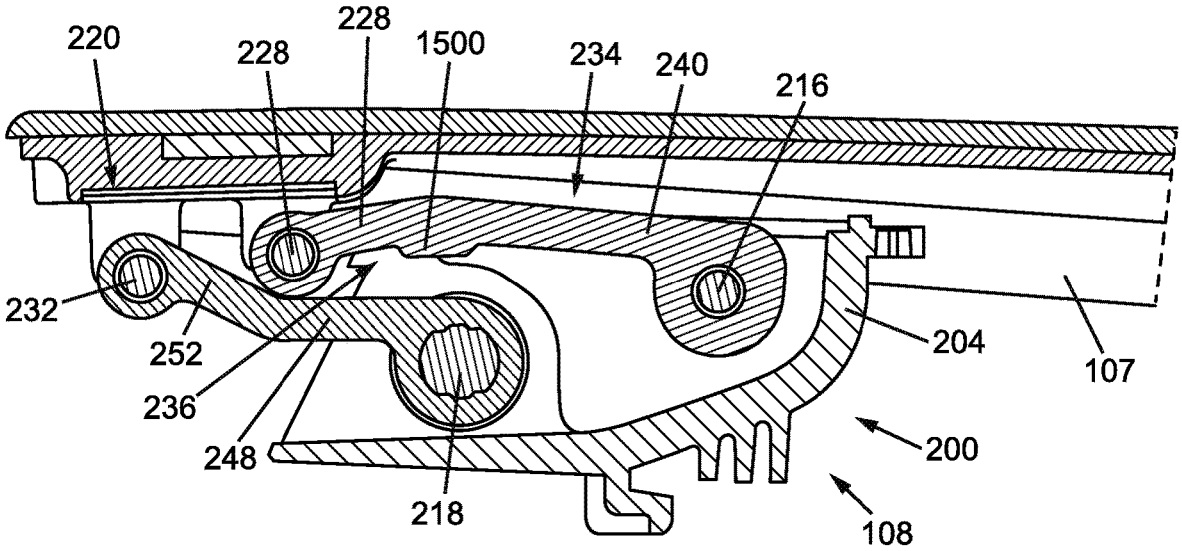
FIG. 18 is yet another cross-sectional view of the portion of the toilet shown in FIG. 12 taken about plane B-B.

As shown in FIG. 15, the hinge assembly 108 is in the first position, the second hinge member 236 contacts a mechanical stop 1500 (e.g., projection, protrusion, etc.) to prevent further movement of the second hinge member 236 towards the mounting base coupler front wall 204. The mechanical stop 1500 may be structurally integrated within the first hinge member 234.

III. Configuration of Exemplary Embodiments

As utilized herein, the terms "about," "generally," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure.

The terms "coupled," "attached," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "upper," etc.) are merely used to describe the orientation of various elements in the FIGURES. It should be noted that the orientation of various elements may differ according to other exemplary embodiments and that such variations are intended to be encompassed by the present disclosure.

The construction and arrangement of the elements of the toilet 100, the hinge assembly 108, and all other elements and assemblies as shown in the exemplary embodiments are illustrative only. Although only a number of embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions, and arrangement of the various exemplary embodiments without departing from the scope of the present disclosure. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

What is claimed is:

1. A toilet comprising:

a body comprising:

a toilet bowl; and a body top surface contiguous with the toilet bowl;

a toilet lid assembly comprising a toilet lid configured to cover the toilet bowl; and a hinge assembly operable between a first position to open the toilet lid and a second position to cover the toilet bowl, the hinge assembly comprising:

a mounting base coupler coupled to the body top surface;

a toilet lid coupler coupled to the toilet lid;

a first hinge member coupled to the mounting base coupler and the toilet lid coupler; and a second hinge member coupled to the mounting base coupler and the toilet lid coupler;

wherein the first hinge member and the second hinge member are configured to rotate relative to the mounting base coupler as the hinge assembly transitions between the first position and the second position; and wherein the first hinge member and the second hinge member are configured to rotate in opposite rotational directions as the hinge assembly transitions between the first position and the second position.

2. The toilet of claim 1, wherein:

the lid does not cover the bowl when the hinge assembly is in the first position; and the lid is only coupled to the body through the first hinge member and the second hinge member.

3. The toilet of claim 1, wherein:

the mounting base coupler comprises:

a mounting base coupler first bore; and a mounting base coupler second bore;

the lid coupler comprises:

a lid coupler first bore; and a lid coupler second bore;

the first hinge member comprises:

a first hinge member first bore; and a first hinge member second bore; and the second hinge member comprises:

a second hinge member first bore; and a second hinge member second bore.

4. The toilet of claim 3, wherein the mounting base coupler first bore, the mounting base coupler second bore, the lid coupler first bore, the lid coupler second bore, the first hinge member first bore, the first hinge member second bore, the second hinge member first bore, and the second hinge member second bore are parallel.

5. The toilet of claim 3, wherein:

the first hinge member is configured to be coupled to the mounting base coupler such that the first hinge member first bore is aligned with the mounting base coupler first bore;

the second hinge member is configured to be coupled to the mounting base coupler such that the second hinge member first bore is aligned with the mounting base coupler second bore;

the first hinge member is configured to be coupled to the lid coupler such that the first hinge member second bore is aligned with the lid coupler first bore; and the second hinge member is configured to be coupled to the lid coupler such that the second hinge member second bore is aligned with the lid coupler second bore.

6. The toilet of claim 3, wherein the hinge assembly further comprises:

a first hinge pin positioned within the first hinge member first bore and the mounting base coupler first bore;

a second hinge pin positioned within the second hinge member first bore and the mounting base coupler second bore;

a third hinge pin positioned within the first hinge member second bore and the lid coupler first bore; and a fourth hinge pin positioned within the second hinge member second bore and the lid coupler second bore.

7. The toilet of claim 6, wherein:

the first hinge member rotates about the first hinge pin or the first hinge pin rotates within the first hinge member, as the hinge assembly transitions between the first position and the second position;

the first hinge member rotates about the third hinge pin or the third hinge pin rotates within the first hinge member, as the hinge assembly transitions between the first position and the second position;

the second hinge member rotates about the second hinge pin or the second hinge pin rotates within the second hinge member, as the hinge assembly transitions between the first position and the second position; and the second hinge member rotates about the fourth hinge pin or the fourth hinge pin rotates within the second hinge member, as the hinge assembly transitions between the first position and the second position.

8. The toilet of claim 6, wherein:

the third hinge pin is located above the first hinge pin and the second hinge pin when the hinge assembly is in the first position; and the fourth hinge pin is located above the first hinge pin and the second hinge pin when the hinge assembly is in the first position.

9. The toilet of claim 8, wherein the third hinge pin is located above the fourth hinge pin when the hinge assembly is in the first position.

10. The toilet of claim 9, wherein the first hinge pin is located between the second hinge pin and the bowl.

11. The toilet of claim 1, wherein the lid is separated from the body top surface by an angle that is between 90 degrees and 120 degrees, inclusive, when the hinge assembly is in the first position.

12. The toilet of claim 1, wherein the first hinge member and the second hinge member are in contact when the hinge assembly is in the first position and when the hinge assembly is in the second position.

13. A hinge assembly for a toilet having a body and a lid and operable between a first position and a second position, the hinge assembly comprising:

a mounting base coupler configured to be coupled to the body;

a lid coupler configured to be coupled to the lid;

a first hinge member coupled to the mounting base coupler and the lid coupler; and a second hinge member coupled to the mounting base coupler and the lid coupler;

wherein the first hinge member and the second hinge member are configured to rotate relative to the mounting base coupler as the hinge assembly transitions between the first position and the second position; and wherein the first hinge member and the second hinge member are configured to rotate in opposite rotational directions as the hinge assembly transitions between the first position and the second position.

14. The hinge assembly of claim 13, further comprising:

a first hinge pin;

a second hinge pin;

a third hinge pin; and a fourth hinge pin;

wherein the mounting base coupler comprises:

a mounting base coupler first bore; and a mounting base coupler second bore;

wherein the lid coupler comprises:

a lid coupler first bore; and a lid coupler second bore;

wherein the first hinge member comprises:

a first hinge member first bore; and a first hinge member second bore;

wherein the second hinge member comprises:

a second hinge member first bore; and a second hinge member second bore;

wherein the first hinge pin is positioned within the first hinge member first bore and the mounting base coupler first bore;

wherein the second hinge pin is positioned within the second hinge member first bore and the mounting base coupler second bore;

wherein the third hinge pin is positioned within the first hinge member second bore and the lid coupler first bore; and wherein the fourth hinge pin is positioned within the second hinge member second bore and the lid coupler second bore.

15. The hinge assembly of claim 14, wherein, as the hinge assembly transitions between the first position and the second position:

the first hinge member rotates about the first hinge pin or the first hinge pin rotates within the first hinge member;

the first hinge member rotates about the third hinge pin or the third hinge pin rotates within the first hinge member;

the second hinge member rotates about the second hinge pin or the second hinge pin rotates within the second hinge member; and the second hinge member rotates about the fourth hinge pin or the fourth hinge pin rotates within the second hinge member.

16. The hinge assembly of claim 13, wherein the first hinge member and the second hinge member are in contact when the hinge assembly is in the first position and when the hinge assembly is in the second position.

17. A toilet comprising: a body comprising:

a bowl; and a body top surface contiguous with the bowl;

a lid assembly comprising a lid configured to cover the bowl; and a hinge assembly operable between a first position and a second position, the hinge assembly comprising:

a mounting base coupler coupled to the body top surface and comprising a mounting base coupler first bore;

a lid coupler coupled to the lid and comprising a lid coupler first bore;

a first hinge member coupled to the mounting base coupler and the lid coupler and comprising a first hinge member first bore and a first hinge member second bore;

a second hinge member;

a first hinge pin positioned within the first hinge member first bore and the mounting base coupler first bore; and a third hinge pin positioned within the first hinge member second bore and the lid coupler first bore;

wherein the first hinge member and the second hinge member are is configured to rotate in opposite directions relative to the mounting base coupler as the hinge assembly transitions between the first position and the second position;

wherein the lid covers the bowl when the hinge assembly is in the second position; and wherein the first hinge pin is parallel to the third hinge pin.

18. The toilet of claim 17, wherein:

the first hinge member rotates about the first hinge pin or the first hinge pin rotates within the first hinge member, as the hinge assembly transitions between the first position and the second position; and the first hinge member rotates about the third hinge pin or the third hinge pin rotates within the first hinge member, as the hinge assembly transitions between the first position and the second position.

19. The toilet of claim 17, wherein the lid is separated from the body top surface by an angle that is between 90 degrees and 120 degrees, inclusive, when the hinge assembly is in the first position.

* * * * *